US012303022B2

(12) United States Patent
Meyer et al.

(10) Patent No.: US 12,303,022 B2
(45) Date of Patent: May 20, 2025

(54) ADJUSTABLE DESK FRAME

(71) Applicant: CKnapp Sales, Inc., Goodfield, IL (US)

(72) Inventors: Brandon Meyer, Normal, IL (US); Nicholas Welander, East Peoria, IL (US); Micah Fehr, Danvers, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 113 days.

(21) Appl. No.: 18/117,253

(22) Filed: Mar. 3, 2023

(65) Prior Publication Data

US 2024/0292944 A1 Sep. 5, 2024

(51) Int. Cl.

| | |
|---|---|
| ***A47B 1/08*** | (2006.01) |
| ***A47B 9/20*** | (2006.01) |
| ***A47B 21/02*** | (2006.01) |

(52) U.S. Cl.

CPC ..... *A47B 1/08* (2013.01); *A47B 9/20* (2013.01); *A47B 21/02* (2013.01); *A47B 2200/0051* (2013.01); *A47B 2200/0056* (2013.01)

(58) Field of Classification Search

CPC .... A47B 9/04; A47B 9/08; A47B 9/06; A47B 9/20; A47B 2009/046; A47B 2009/065; A47B 17/02; A47B 21/0314; A47B 21/02; A47B 21/04; A47B 2200/0071; A47B 2200/0075; A47B 2200/12; A47B 2200/0073; A47B 2200/0097; A47B 2200/0062; A47B 2200/0051; A47B 2200/0056; A47B 2200/0054;

(Continued)

(56) References Cited

U.S. PATENT DOCUMENTS

| | | | |
|---|---|---|---|
| 4,381,714 A | 5/1983 | Henneberg et al. | |
| 5,408,940 A | 4/1995 | Winchell | |
| 5,437,236 A | 8/1995 | Zeiner | |

(Continued)

FOREIGN PATENT DOCUMENTS

| | | | | |
|---|---|---|---|---|
| CN | 104872994 A | * | 9/2015 | ..... A47B 9/04 |
| CN | 214594809 U | * | 11/2021 | |

(Continued)

OTHER PUBLICATIONS

KR20160021696 English translation (Year: 2016).*
English translation DE202021104355 (Year: 2021).*
CN214594809 English translation (Year: 2021).*

*Primary Examiner* — Janet M Wilkens
(74) *Attorney, Agent, or Firm* — Lund IP, PLLC

(57) ABSTRACT

An adjustable desk frame includes a first extendable table leg including a first outer housing, a first inner housing, and a first actuation mechanism to selectively extend and retract the first inner housing relative to the first outer housing, a second extendable table leg including a second outer housing, a second inner housing, and a second actuation mechanism to selectively extend and retract the second inner housing relative to the second outer housing, a motor configured to drive the first actuation mechanism to selectively extend and retract the first inner housing relative to the first outer housing, and a linkage coupling the motor to the second actuation mechanism such that the motor is configured to drive the second actuation mechanism in unison with the first actuation mechanism.

23 Claims, 11 Drawing Sheets

(58) Field of Classification Search
CPC .... A47B 2200/0058; A47B 2200/0059; A47B 2021/0364; A47B 2021/066
USPC ..... 108/144.11, 147, 20, 147.19, 96; 248/188.2, 188.5
See application file for complete search history.

(56) References Cited

U.S. PATENT DOCUMENTS

| | | | | |
|---|---|---|---|---|
| 7,908,981 | B2 | 3/2011 | Agee | |
| 8,291,833 | B2 | 10/2012 | Skiba | |
| 9,700,135 | B2 | 7/2017 | Herring et al. | |
| 9,703,278 | B2 | 7/2017 | Kristensen | |
| 9,989,133 | B2 | 6/2018 | Wu | |
| 10,114,352 | B2 | 10/2018 | Matlin | |
| 10,244,861 | B1 | 4/2019 | Poniatowski | |
| D878,813 | S | 3/2020 | Knapp et al. | |
| 10,588,401 | B1 | 3/2020 | Lu | |
| D882,986 | S | 5/2020 | Knapp et al. | |
| D885,089 | S | 5/2020 | Knapp et al. | |
| D885,090 | S | 5/2020 | Knapp et al. | |
| 10,842,258 | B2 | 11/2020 | Applegate et al. | |
| 10,863,820 | B1 | 12/2020 | Lin | |
| 10,893,748 | B1 | 1/2021 | Poniatowski | |
| 11,089,865 | B2 | 8/2021 | Knapp et al. | |
| 11,096,481 | B2 | 8/2021 | Patton et al. | |
| 11,134,777 | B2 | 10/2021 | Knapp et al. | |
| D965,349 | S | 10/2022 | Cheng et al. | |
| D966,016 | S | 10/2022 | Wang | |
| D966,752 | S | 10/2022 | Wang | |
| D972,342 | S | 12/2022 | Chen | |
| 11,553,789 | B2 | 1/2023 | Knapp et al. | |
| 11,647,831 | B2 * | 5/2023 | Pan | A47B 9/10 108/147 |
| 2008/0289545 | A1 | 11/2008 | Picchio | |
| 2012/0043436 | A1 | 2/2012 | Atkinson | |
| 2016/0102693 | A1 * | 4/2016 | Wang | F16M 11/28 248/161 |
| 2017/0303679 | A1 * | 10/2017 | Tseng | A47B 9/04 |
| 2020/0154876 | A1 | 5/2020 | Liu | |
| 2020/0170404 | A1 | 6/2020 | Knapp et al. | |
| 2020/0260862 | A1 | 8/2020 | Knapp et al. | |
| 2021/0037963 | A1 | 2/2021 | Knapp et al. | |
| 2022/0304463 | A1 | 9/2022 | Zhu | |
| 2023/0309688 | A1 * | 10/2023 | Xiang | A47B 9/20 108/147 |

FOREIGN PATENT DOCUMENTS

| | | | | | |
|---|---|---|---|---|---|
| CN | 214904563 | U | * | 11/2021 | A47B 9/04 |
| CN | 215423320 | U | * | 1/2022 | |
| DE | 202021104355 | U1 | * | 9/2021 | A47B 3/0913 |
| EP | 2823731 | A2 | * | 1/2015 | A47B 13/02 |
| KR | 20160021696 | A | * | 2/2016 | |
| KR | 20170042920 | A | * | 4/2017 | |

* cited by examiner

ADJUSTABLE DESK FRAME

TECHNICAL FIELD

This disclosure relates to adjustable height desks.

BACKGROUND

Adjustable height desks allow users to customize workspace and viewing heights to their individual preferences for both standing and sitting.

BRIEF SUMMARY

Adjustable height desk frames disclosed herein include adjustable height legs interconnected with an adjustable fame suitable for mounting different desktops of a range of widths and heights. Examples include two motors, each configured to drive extension and retraction of two separate legs. The motors can operate in unison to maintain a level desktop surface.

In one example, an adjustable desk frame includes a first extendable table leg including a first outer housing, a first inner housing, and a first actuation mechanism to selectively extend and retract the first inner housing relative to the first outer housing, a second extendable table leg including a second outer housing, a second inner housing, and a second actuation mechanism to selectively extend and retract the second inner housing relative to the second outer housing, a motor configured to drive the first actuation mechanism to selectively extend and retract the first inner housing relative to the first outer housing, and a linkage coupling the motor to the second actuation mechanism such that the motor is configured to drive the second actuation mechanism in unison with the first actuation mechanism.

In another example, a kit for an adjustable desk frame includes a first extendable table leg including a first outer housing, a first inner housing, and a first actuation mechanism to selectively extend and retract the first inner housing relative to the first outer housing, a second extendable table leg including a second outer housing, a second inner housing, and a second actuation mechanism to selectively extend and retract the second inner housing relative to the second outer housing, a first motor configured to drive the first actuation mechanism to selectively extend and retract the first inner housing relative to the first outer housing, a first linkage configured to couple the first motor to the second actuation mechanism such that the first motor is configured to drive the second actuation mechanism in unison with the first actuation mechanism, a third extendable table leg including a third outer housing, a third inner housing, and a third actuation mechanism to selectively extend and retract the third inner housing relative to the third outer housing, a fourth extendable table leg including a fourth outer housing, a fourth inner housing, and a fourth actuation mechanism to selectively extend and retract the fourth inner housing relative to the fourth outer housing, a second motor configured to drive the third actuation mechanism to selectively extend and retract the third inner housing relative to the third outer housing, a second linkage coupling the second motor to the fourth actuation mechanism such that the motor is configured to drive the fourth actuation mechanism in unison with the third actuation mechanism, a first crossbar coupling the first outer housing of the first extendable table leg to the second outer housing of the second extendable table leg, and a second crossbar coupling the third outer housing of the third extendable table leg to the fourth outer housing of the fourth extendable table leg.

DETAILED DESCRIPTION

Figure 1A:
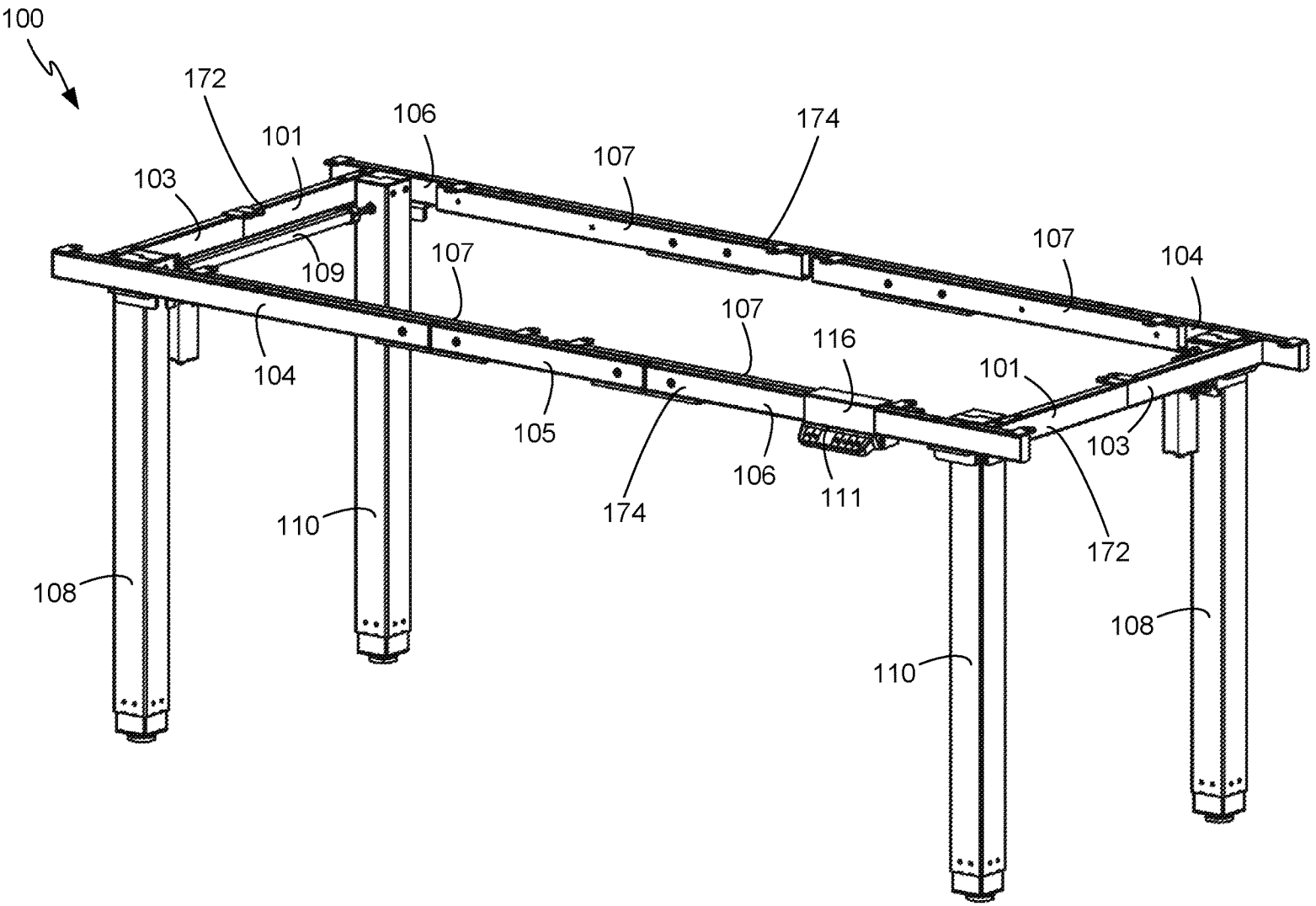
FIGS. 1A and 1B illustrate an adjustable desk frame and components thereof.
Figure 1B:
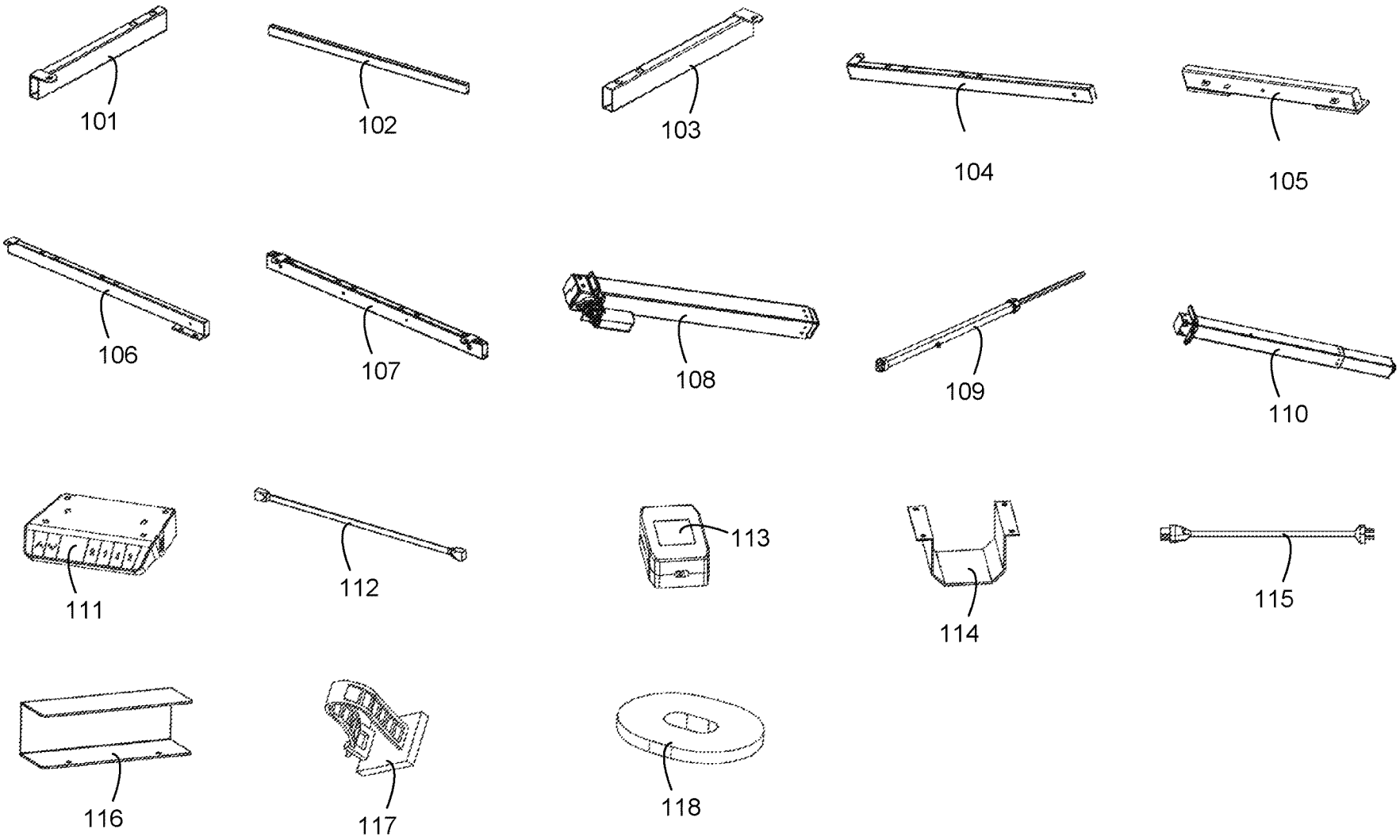

FIG. 1A illustrates an adjustable desk frame 100. In some examples, adjustable desk frame 100 may be sold as a kit without a separate desktop. Separate components in an example kit for adjustable desk frame 100 are shown in FIG. 1B. These components include:

Short left crossbar 101 (×2)
Inner crossbar 102 (×2)
Short right crossbar 103 (×2)
Long right crossbar 104 (×2)
Short middle crossbar 105 (×2)
Long left crossbar 106 (×2)
Long middle crossbar 107 (×4)
Motorized leg 108 (×2)
Linkage 109 (×2)
Actuatable leg 110 (×2)
Control panel 111 (×1)
Extension cable 112 (×2)
Power adapter 113 (×1)
Adapter bracket 114 (×1)
Power cable 115 (×1)
Control panel spacer 116 (×1)
Cable clips 117 (×5)
Rubber pads 118 (×10)

Figure 2A:
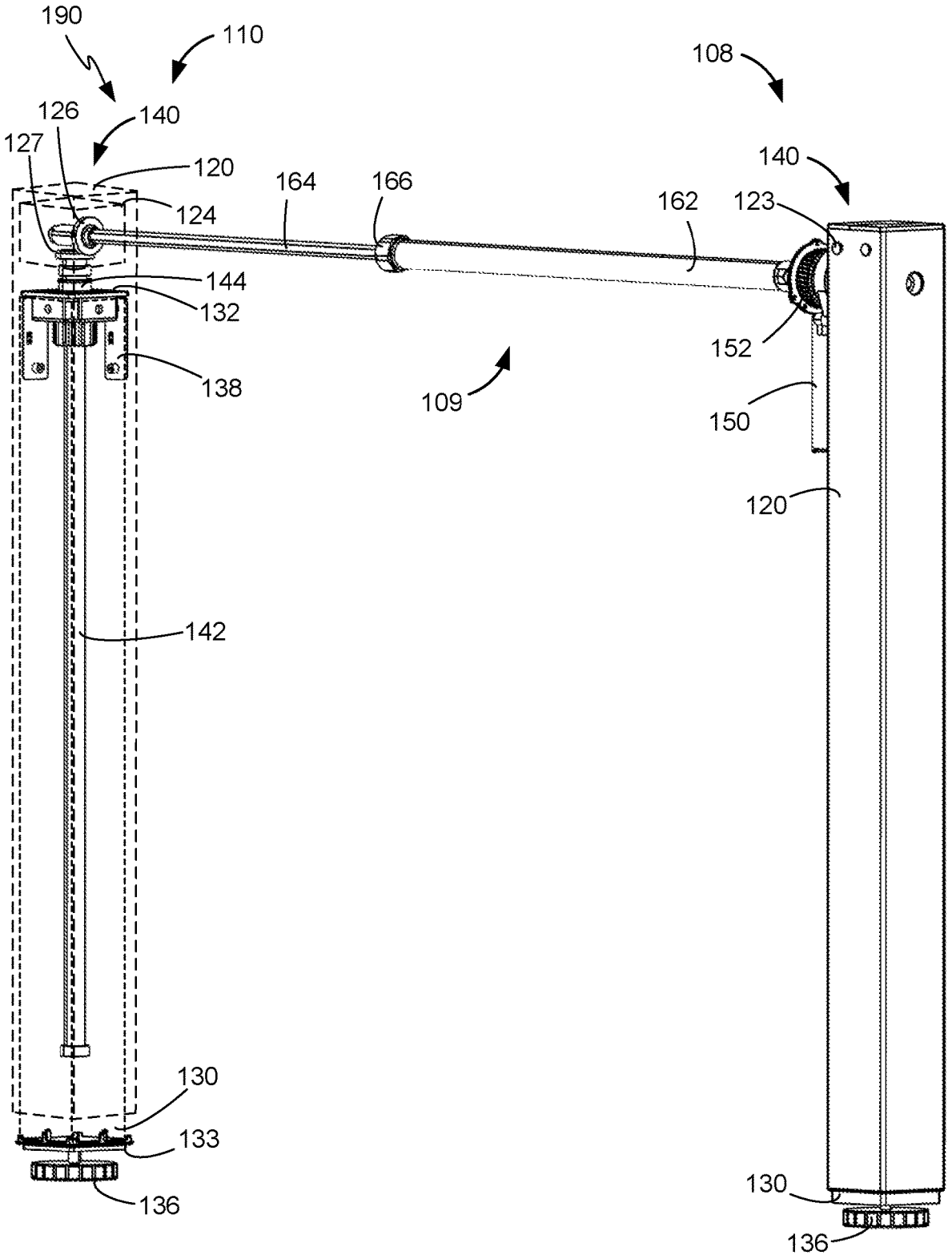
FIGS. 2A-2D illustrate an assembly including two adjustable height legs driven by a single motor.
Figure 2B:
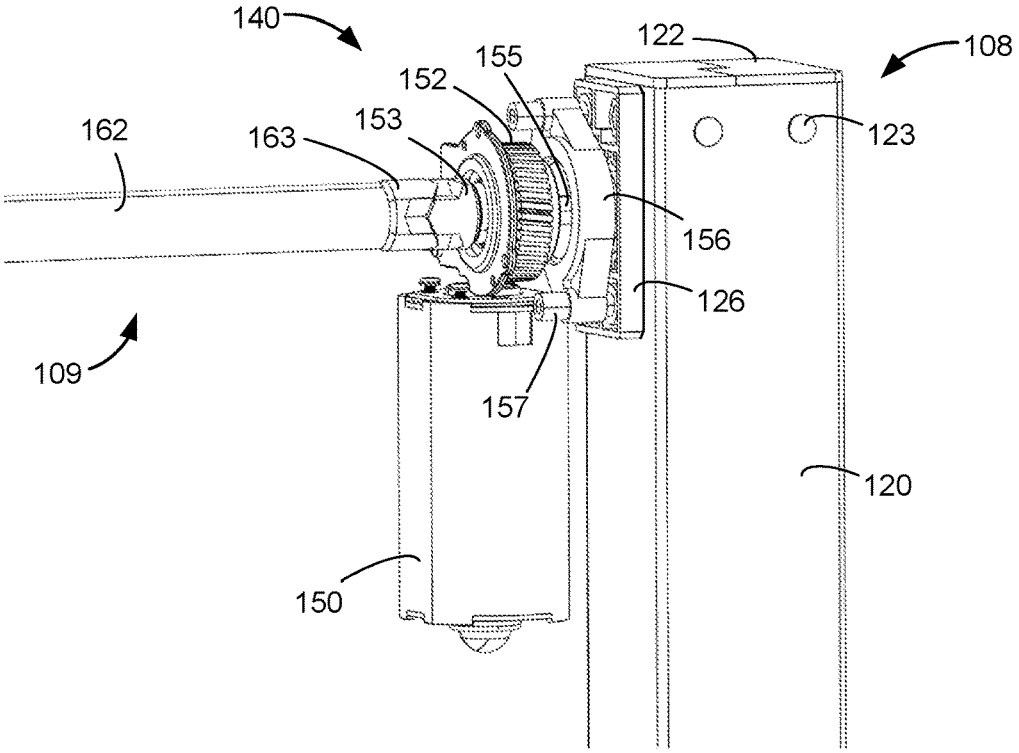
Figure 2C:
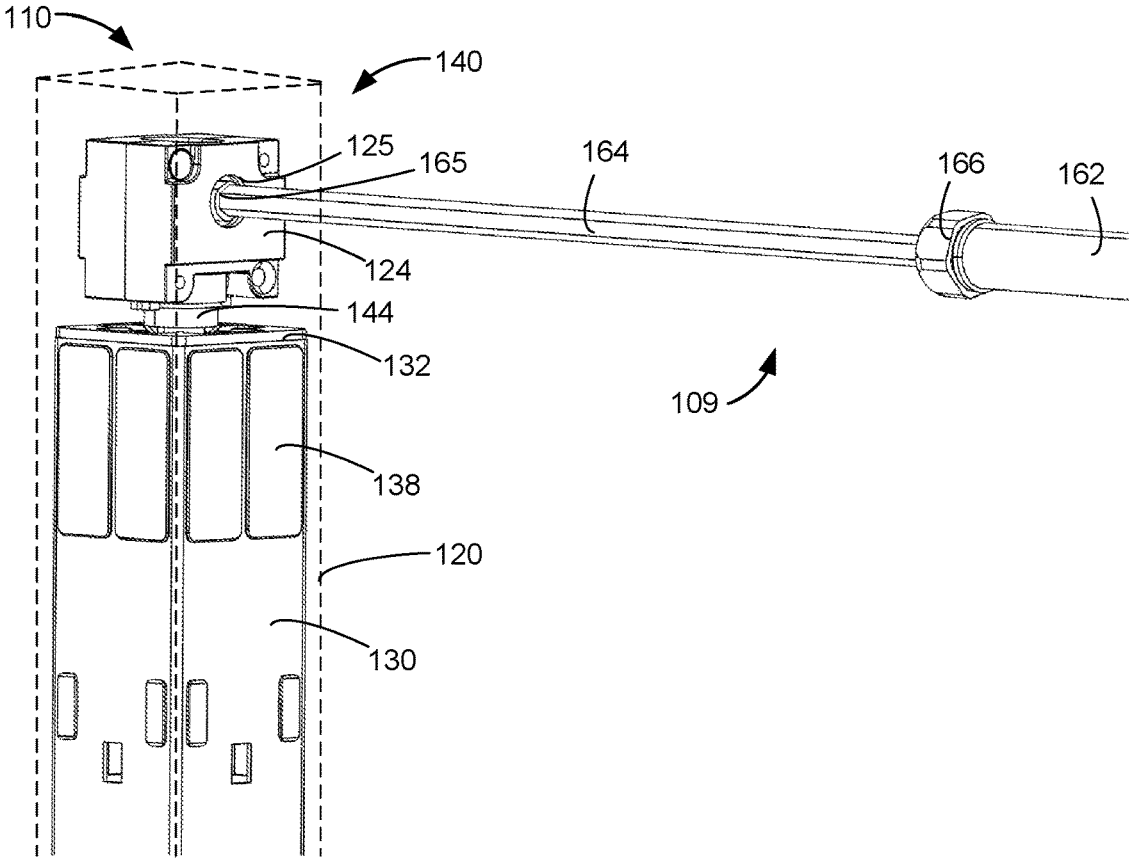
Figure 2D:
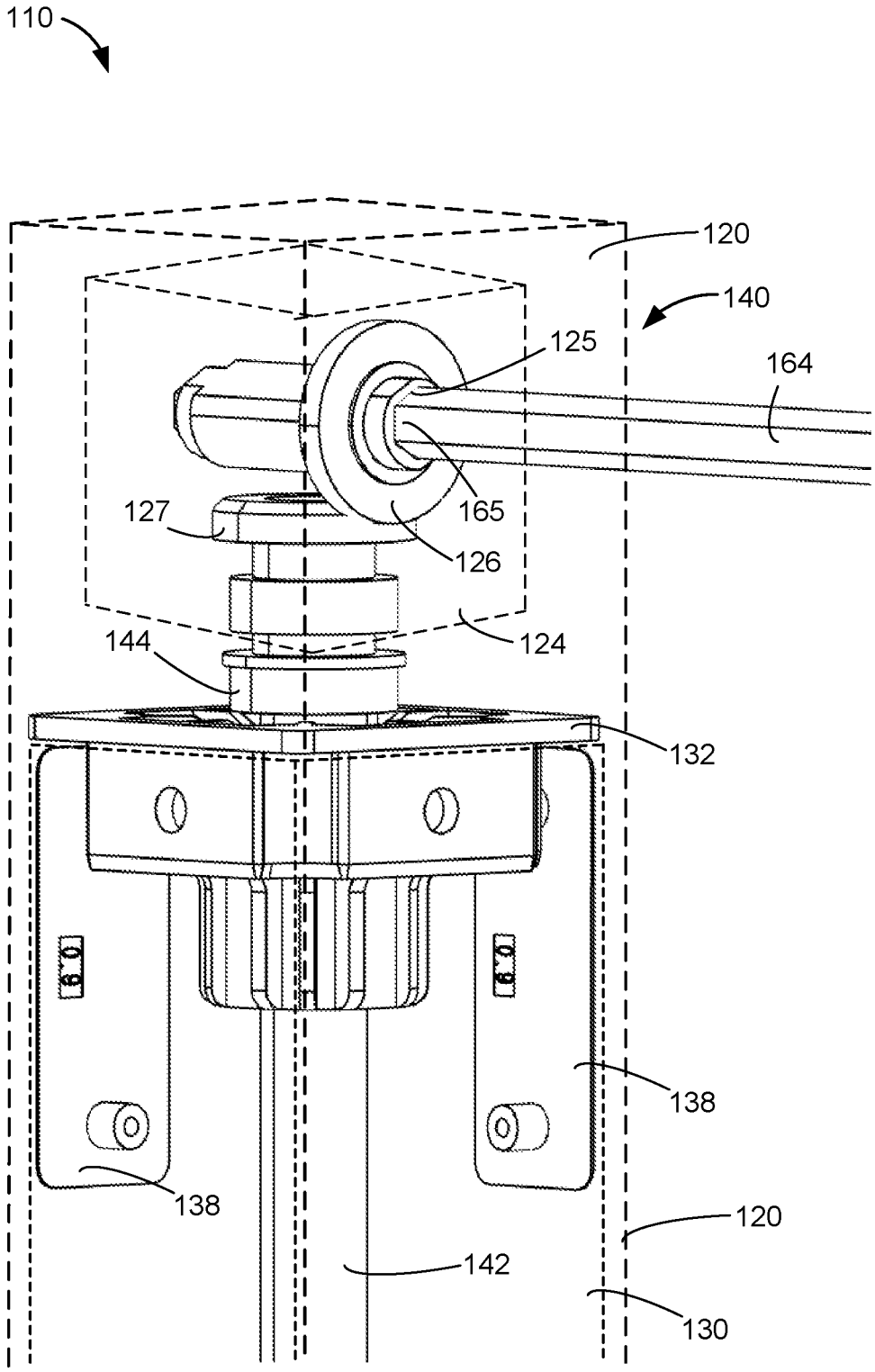

Adjustable desk frame 100 includes four extendable table legs: two motorized extendable table legs 108, and two adjustable extendable table legs 110. Each extendable table leg 108, 110 includes an outer housing 120, an inner housing 130, and an actuation mechanism 140 to selectively extend and retract the inner housing 130 relative to the outer housing 120. Outer housing 120 includes an optional cap 122 on one end and an open end on the opposite end. Inner housing 130 protrudes out the open end of outer housing 120. Inner housing 130 includes a cap 133 including a threaded hole that adjustably receives the threaded shaft of leg foot 136 (FIG. 2A).

Extendable table legs 108 include a motor 150 mounted to the outer housing 120 to drive their actuation mechanisms 140. Specifically motor assembly 150 includes a mounting plate 155 which is secured to a corresponding mounting plate 156 on outer housing 120 with screws 157. Mounting plate 156 may be secured to outer housing 120 by any suitable technique such as welding, screws, or rivets.

In contrast to extendable table legs 108, extendable table legs 110 do not include a motor 150. Instead, extendable table legs 110 each include a socket 125 configured to couple to an external drive to drive their actuation mechanism 140 to selectively extend and retract their inner housing 130 relative to their outer housing 120. In the assembled adjustable desk frame 100, linkages 109 couple the motor 150 of an extendable table leg 108 to the actuation mechanism 140 of the adjacent extendable table leg 110 such that the motor 150 is configured to drive the actuation mechanism 140 of the extendable table leg 110 in unison with the actuation mechanism 140 of the extendable table leg 108.

The adjustable desk frame 100 includes two crossbars 172 coupling an extendable table leg 108 to the adjacent extendable table leg 110. The adjustable desk frame 100 further includes two crossbars 174 coupling the outer housing 120 of an extendable table leg 108 to the outer housing 120 of the extendable table leg 110 on the other side of the desk frame. As shown in FIG. 3F, the adjustable desk frame 100 may further include a desktop 210, with the crossbars 172, 174 each attached to an underside of the desktop 210.

The crossbars 172, 174 each include multiple segments that facilitate adjustable spacing between the extendable table legs 108, 110. Linkage 109 is extendable to facilitate driving the second actuation mechanism 140 in unison with the first actuation mechanism 140 at various spacings between the extendable table leg 108 and the extendable table leg 110. In some examples, crossbars 172, 174 may be adjusted to provide a minimum frame size of 33.5 inches by 59 inches, a maximum frame size of 41.5 inches by 110 inches or incremental frame sizes between the minimum and maximum. The various frame sizes are suitable for table top sizes ranging from a minimum size of 36 inches by 60 inches to a maximum size of 60 inches by 130 inches. Other examples are suitable for smaller or larger desktops.

The multiple segments of each crossbar 172 include a tubular short left crossbar 101 and a tubular short right crossbar 103 coupled together with an inner crossbar 102. The inner crossbar 102 fits within the tubular crossbars 101, 103 to facilitate the adjustable spacing. The multiple segments of each crossbar 174 include a long left crossbar 106 and a long right crossbar 104 coupled together three additional crossbar segments: two long middle crossbars 107 and a short middle crossbar 105. The relative positions of crossbars 104, 105, 106, 107 may be selected to facilitate different lengths of crossbar 174. In particular, each long middle crossbar 107 includes a plurality of mounting holes for adjustable attachment to the adjacent long left crossbar 106 or the adjacent the long right crossbar 104. For example, the individual mounting holes may be spaced between 1 and 12 inches apart, such as 8 inches apart. In addition, even smaller lengths of crossbar 174 may be provided by using a single long middle crossbar 107 to connect the long left crossbar 106 to the long right crossbar 104, thereby omitting the short middle crossbar 105 and the other long middle crossbar 107.

Using multiple segments for crossbars 172, 174 allow adjustable desk frame 100 to conform to multiple desktop sizes. In addition, the multiple segments for crossbars 172, 174 reduce overall package dimensions for a kit used to build adjustable desk frame 100. In some examples, a packaging size with a maximum box length of 18 inches may reducing shipping expenses compared to designs requiring larger packaging. In the same or different examples, the components of crossbars 172, 174 may be formed from a thin-walled metal tubes, such as a steel or aluminum tubing. Because the crossbars 172, 174 are mounted to the desktop, lighter weight materials may be utilized.

FIGS. 2A-2D illustrate an assembly including two adjustable height legs 108, 110 driven by a single motor 150. The motor 150 is mounted to the outer housing 120 of the extendable table leg 108. The motor 150 configured to drive their actuation mechanism 140 to selectively extend and retract their inner housing 130 relative to the outer housing 120 of the extendable table leg 108. In contrast, extendable table legs 110 each include a socket 125 configured to couple to an external drive to drive their actuation mechanism 140 to selectively extend and retract their inner housing 130 relative to their outer housing 120. The extendable table legs 108, 110 each include a plurality of glide plates 138 configured to mitigate friction between the outer housing 120 and the inner housing 130.

In the assembled adjustable desk frame 100, linkages 109 couple the motor 150 of an extendable table leg 108 to the actuation mechanism 140 of the adjacent extendable table leg 110 such that the motor 150 is configured to drive the actuation mechanism 140 of the extendable table leg 110 in unison with the actuation mechanism 140 of the extendable table leg 108. The extendable table legs 110 are mechanically equivalent to the extendable legs 108 such the extendable leg 110 extends and retracts in unison with the extendable leg 108 in response to rotation of the motor 150.

The linkage 109 includes a telescopic drive shaft including an outer tube 162 with a central lumen, an inner rod 164 within the central lumen and a fitting 166 configured to selectively fix a position of the inner rod 164 within the central lumen relative to the outer tube 162. In the example of linkage 109, the fitting 166 is a threaded compression fitting 166.

The extendable leg 108 includes a linear actuator 140 including a drive gear 124 coupled to the motor 150, and rotatably fixed relative the outer housing 120, a threaded shaft 142 coupled to the drive gear 124 and extending within the first inner housing 130, and a threaded nut 144 engaged with the threaded shaft 142 and coupled to the inner housing 130 to facilitate the extension and retraction of the inner housing 130 relative to the outer housing 120. The drive gear 124 includes a right angle gear box with an input gear 126 coupled to the motor 150 and an output gear 127 coupled to the threaded shaft 142. A housing of the right angle gear box is coupled to the outer housing 120, e.g., using rivets 123. Outer housing 120 includes an optional cap 122. In some examples, the adjustable desk frame 100 further includes a gear reducer 152 between the motor 150 and the drive gear 127. For example, the gear reducer may include a right angle gear between the motor 150 and the drive gears 124 of the adjustable height legs 108, 110.

Figure 3A:
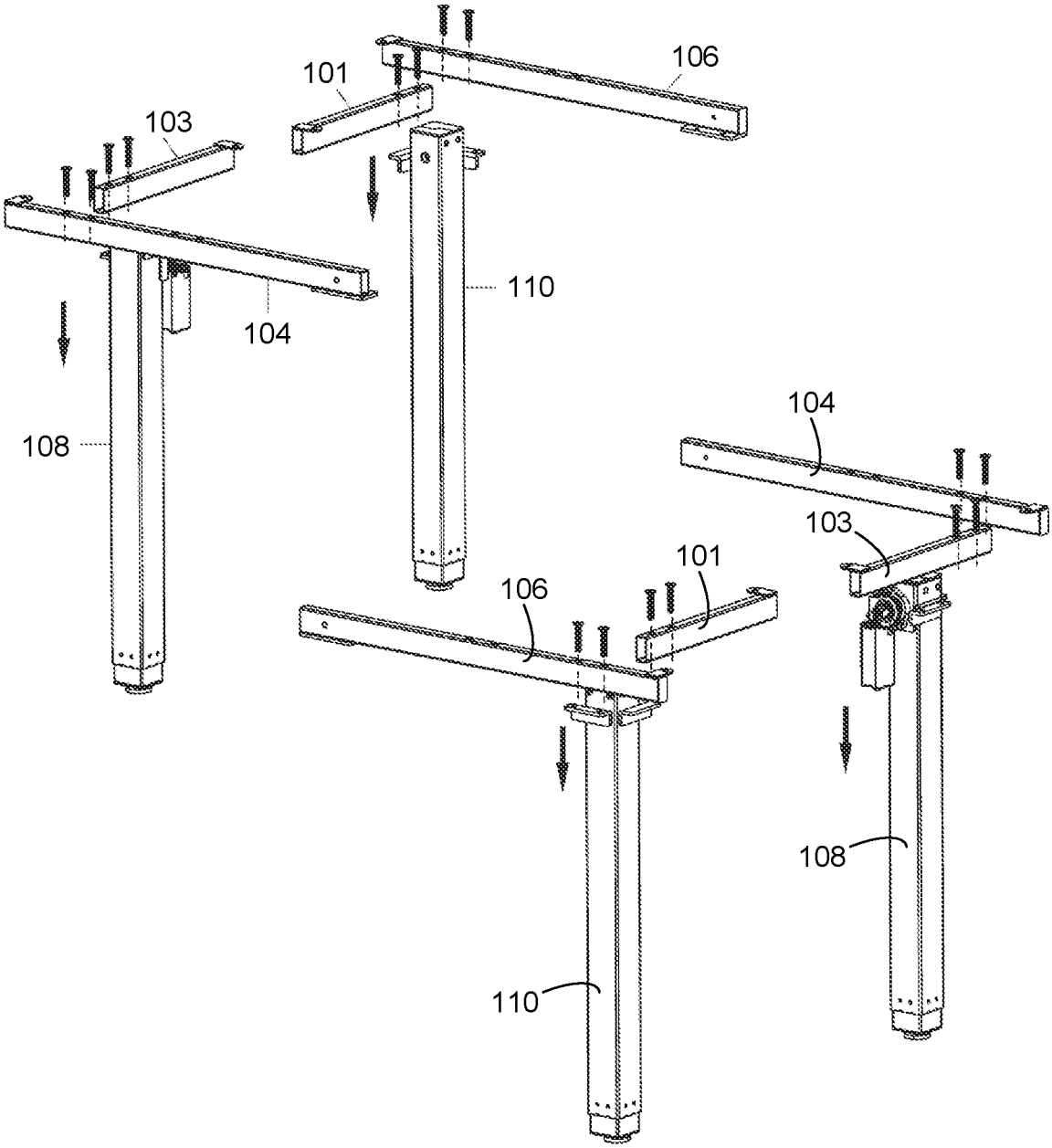
FIGS. 3A-3G illustrate steps for assembling an adjustable desk frame and desktop.
Figure 3B:
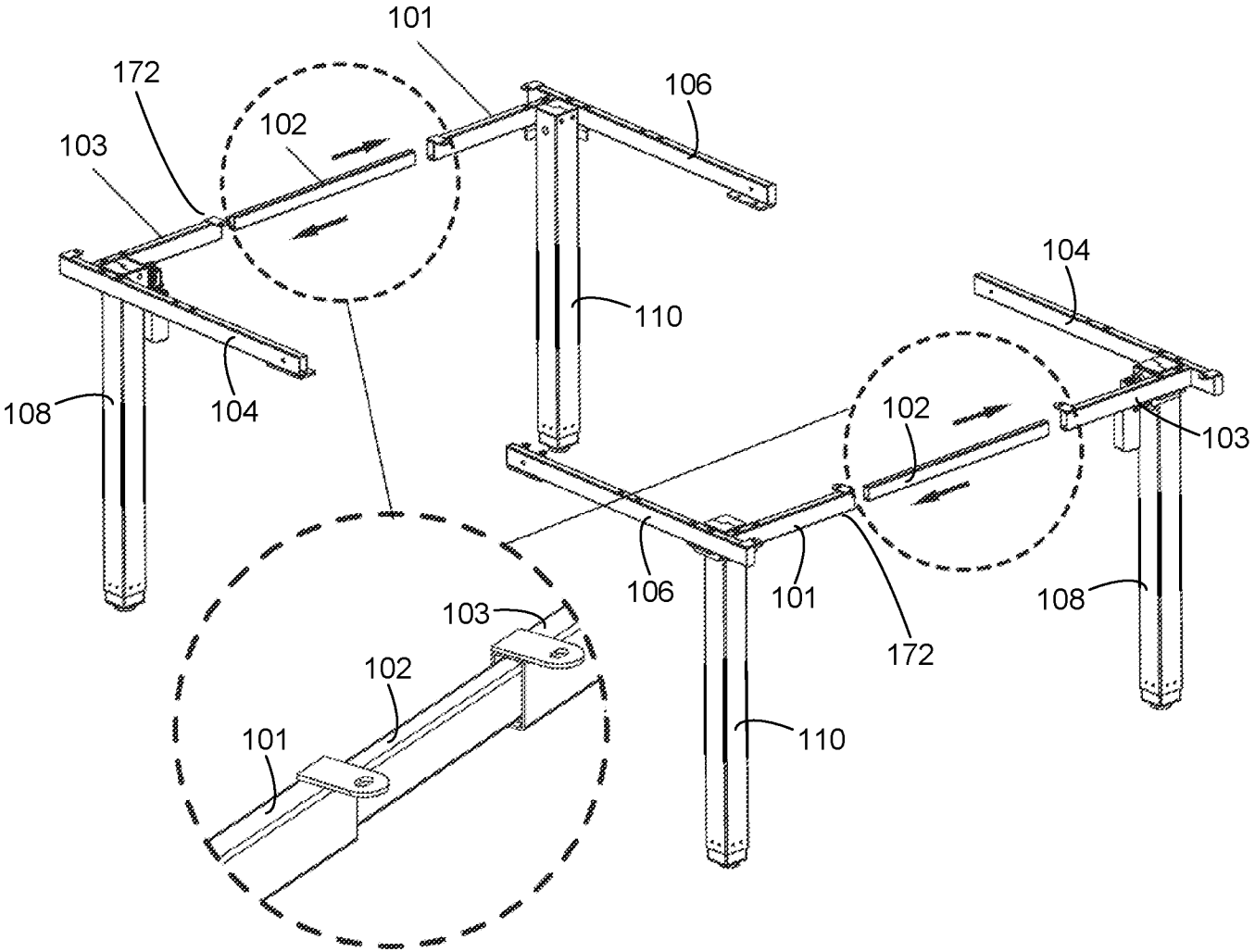
Figure 3C:
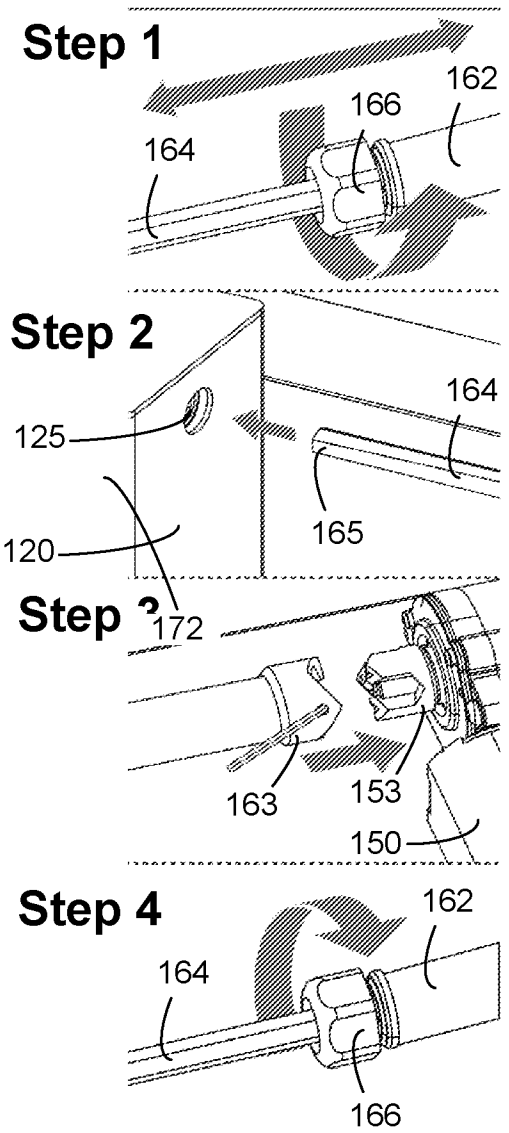
Figure 3C:
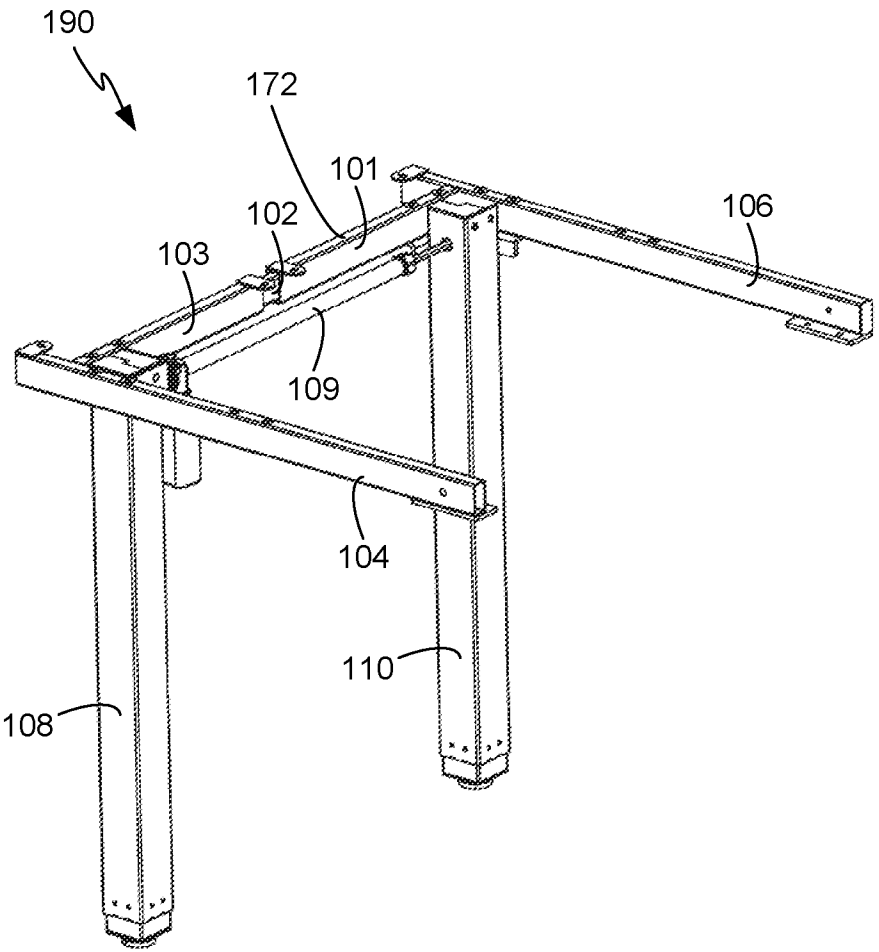
Figure 3D:
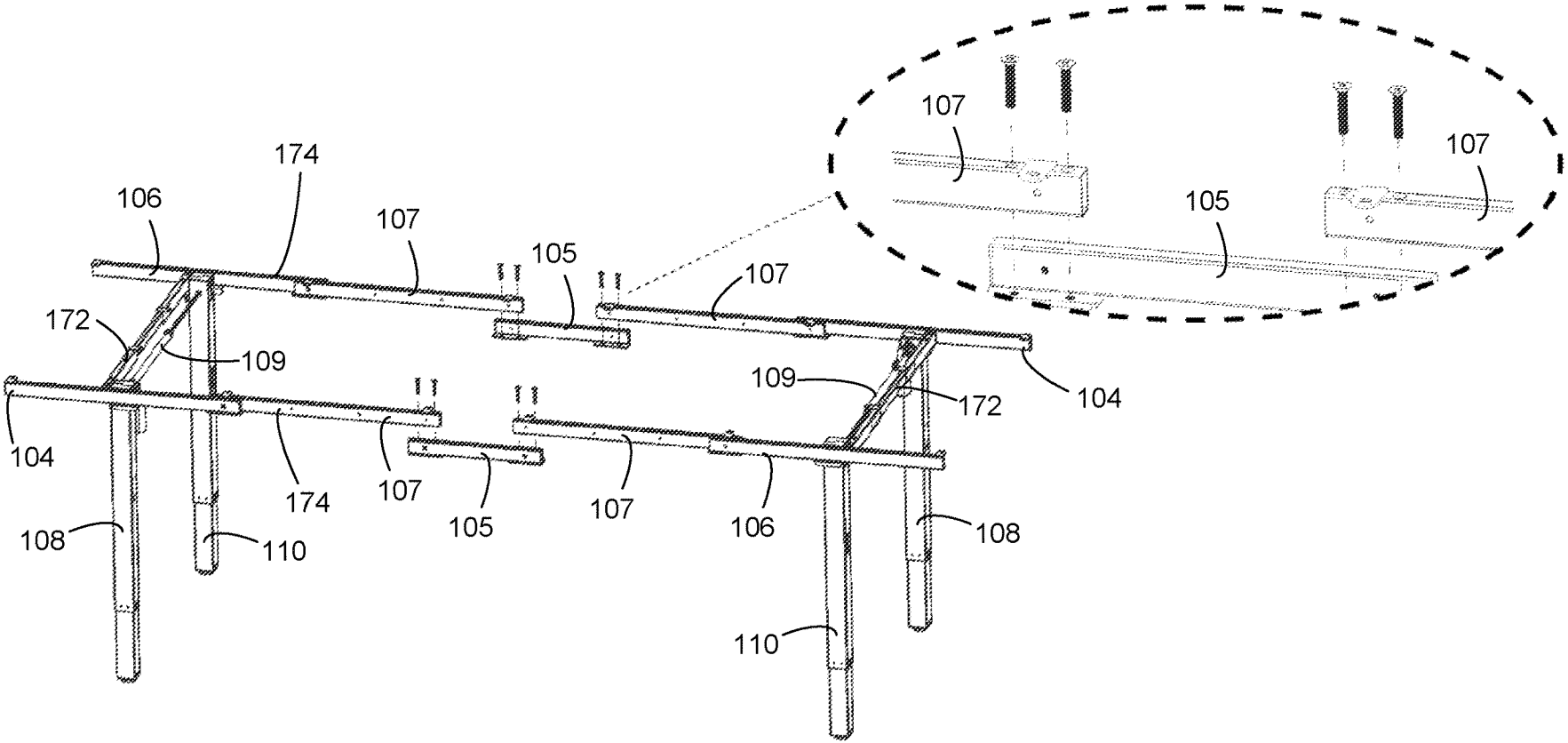
Figure 3E:
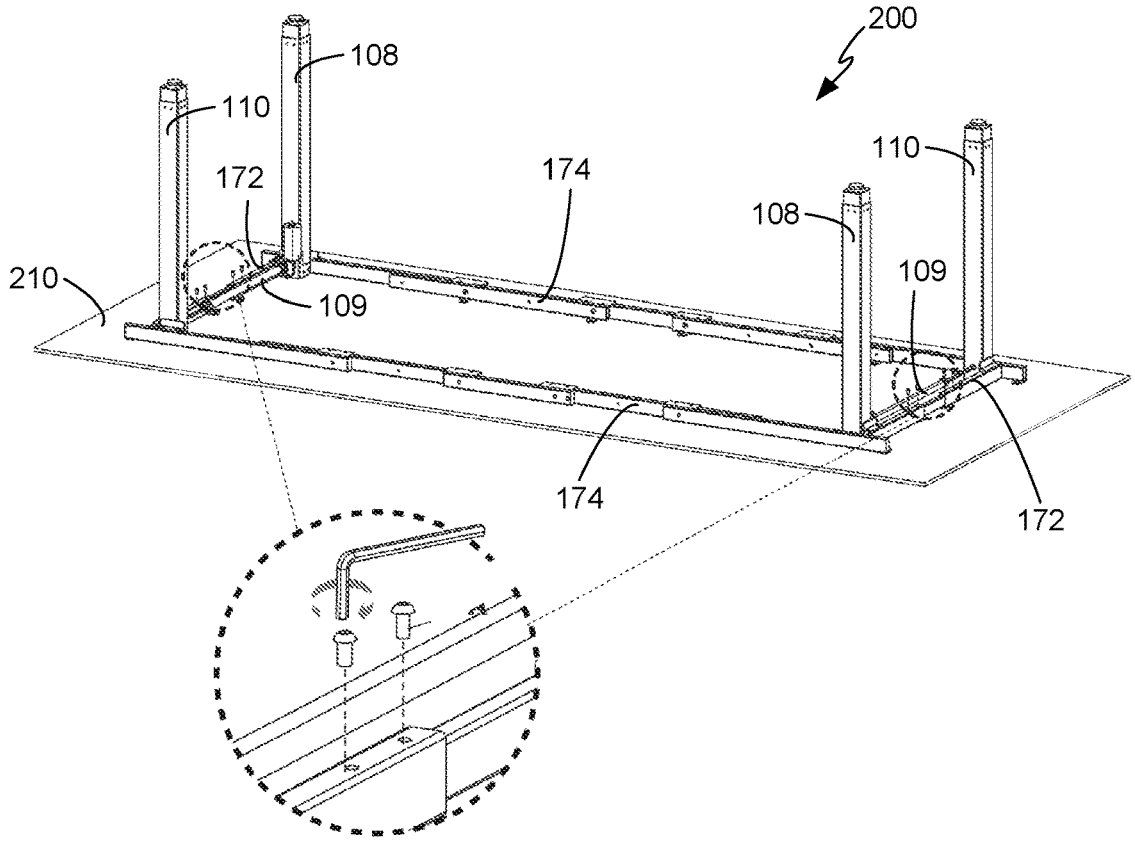
Figure 3F:
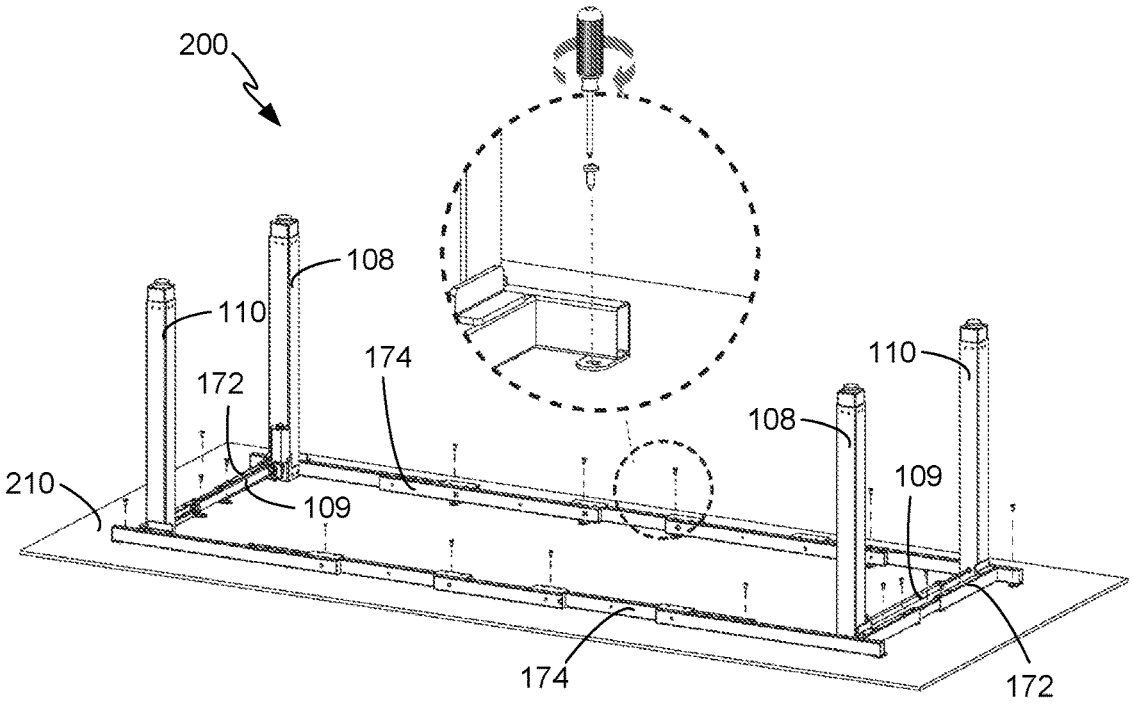
Figure 3G:
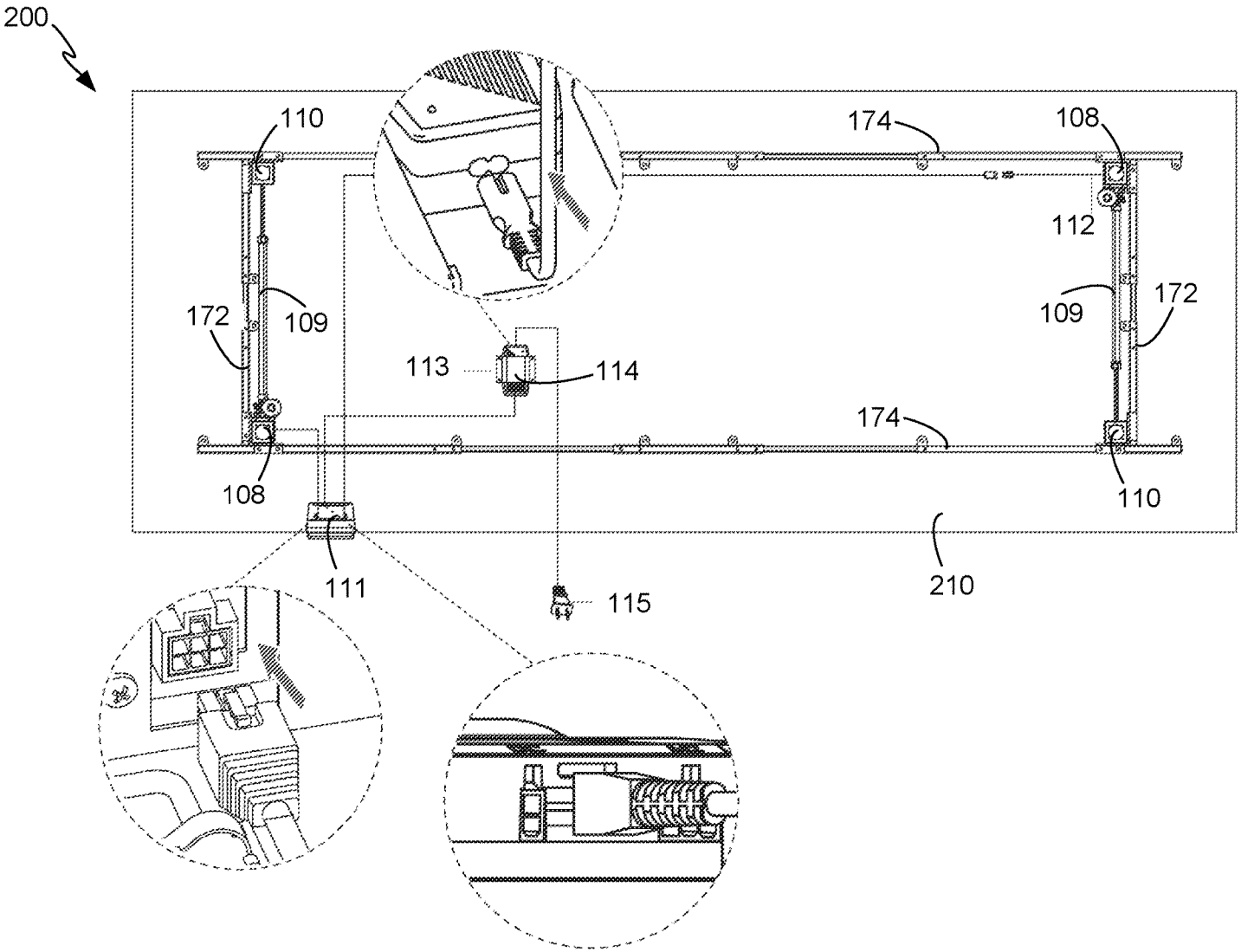

FIGS. 3A-3G illustrate steps for assembling adjustable desk frame 100 and a desktop 210 to form an assembled height adjustable desk 200. Specifically, FIGS. 3A-3C illustrate steps for forming the two leg assemblies 190 of adjustable desk frame 100, FIG. 3D illustrates the step of combining the two leg assemblies 190 with crossbars 174 to form the adjustable desk frame 100, FIGS. 3E and 3F illustrate attaching the adjustable desk frame 100 to desktop 210 to form an assembled height adjustable desk 200, and FIG. 3G illustrates connecting wiring to power and control the assembled height adjustable desk 200. The description of FIGS. 3A-3G includes example details, such as screws and detailed dimensions; however, any suitable fixation mechanisms may be used, and the techniques of this disclosure may be adapted for any desired dimension.

As shown in FIG. 3A, components of the two leg assemblies 190 are joined using M8×47 mm screws and a 5 mm Allen wrench. For each assembly 190, first long left crossbar 106 and short left crossbar 101 are attached to adjustable height leg 110. Then long right crossbar 104 and short right crossbar 103 are attached to adjustable height leg 108. Crossbars 104, 105 include different hole sets that facilitate adjustable spacings of legs 108, 110 in assemblies 190. Using the inner hole set on crossbars 104, 105 allows the desktop surface to overhang more from the legs. The outer holes can be used for less overhang and with larger desktops 210.

FIG. 3B illustrates combining the leg assemblies of FIG. 3A to form two leg assemblies 190. Specifically, the assembly process includes forming crossbar 172 by sliding inner crossbar 102 into the short right and short left crossbars 101, 103 as shown. The slideable connection between inner crossbar 102 and the short right and short left crossbars 101, 103 provides infinite adjustability throughout the maximum and minimum spacing range rather than present mounting locations for the spacings of legs 108, 110 in assemblies 190. Note that the inner crossbars 102 will remain loose until the adjustable desk frame 100 is attached to the desktop 210 (FIG. 3E).

FIG. 3C illustrates installing the linkage 109. First, the assembly process includes loosening the compression fitting 166 on linkage 109 and inserting the end 165 of inner rod 164 into socket 125 of leg 110. In the illustrated example, rod 164 is a hex rod and socket 125 is a hex socket. The assembly process further includes, while holding the end 165 of inner rod 164, pulling the outer tube 162 out until the connector 163 engages with the mating connector 153 of motor 150 on adjustable height leg 108. The assembly process further includes tightening the set screw on linkage 109 using a 2 mm Allen wrench, and then tightening the compression fitting 166. This configuration provides infinite adjustability for the length of linkage 109 rather than present incremental spacings.

FIG. 3D illustrates installing forming crossbars 174. First, the assembly process includes securing the long middle crossbars 107 to left and right long crossbars 104, 106 using M8×47 mm screws and a 5 mm Allen wrench. The illustrate example is for the largest frame size. While dimensions may vary for any size desktop 210, some examples may support a 130 inch by 60 inch desktop 210. To shorten frame, crossbars 174 should be assembled using inner holes sets rather than the outer hole sets. Hole sets are spaced apart to facilitate incremental adjustability. Next the two subassemblies are combined to form crossbars 174 and complete adjustable desk frame 100. Specifically, the assembly process includes attaching middle crossbars 105 to long middle crossbars 107 using M8×47 mm screws and a 5 mm Allen wrench.

FIG. 3E illustrates steps for attaching adjustable desk frame 100 to desktop 210 to form adjustable desk 200. First, the assembly process includes pressing optional rubber pads 118 (not shown) into crossbar tabs that provide mounting points for attaching adjustable desk frame 100 to desktop 210. For example, pads 118 may be formed from a compliant material such an elastomer, foam, or rubber material. The rubber pads 118 may include an optional adhesive layer with a removable backing to facilitate the attachment to the crossbar tabs.

Next, the assembly process includes securing adjustable desk frame 100 to desktop 210. adjustable desk frame 100 is position upside down on the underside of desktop 210. The width of adjustable desk frame 100 may be adjusted as desired and screws are inserted into left and right short crossbars 101, 103 using a 4 mm Allen wrench. This fixes the spacing of legs 108, 110 in each of the two leg assemblies 190.

FIG. 3F illustrates adjustable desk frame 100 to desktop 210 using M5×16 mm screws and a Phillips screwdriver. The screws are inserted into the holes of each crossbar tab and tightened.

FIG. 3G illustrates connecting wiring to power and control the assembled height adjustable desk 200. The assembly process includes attaching adapter bracket 114 to desktop 210 using M5×16 mm screws and a Phillips screwdriver. Then, the assembly process includes sliding power adapter 113 under adapter bracket 114 and attaching control panel 111 to desktop 210 using M4×15 mm screws and a Phillips screwdriver. If there is not enough space on the desktop 210, control panel 111 can be mounted to optional control panel spacer 116 then attached onto a frame crossbar 174.

Connecting power to adjustable desk frame 100 includes connecting the cord from both adjustable height legs 108 to the two slots on control panel 111. Optional extension cable 112 can be connected to adjustable height legs 108 if extra length is needed to reach control panel 111 Power adapter 113 is connected to control panel 111 and power cable 115 is connected to power adapter 113 and a wall outlet. Cable clips 117 may be used to secure the cables to desktop 210. For example, cable clips 117 may include an adhesive layer with a removable backing to facilitate easy attachment to the underside of desktop 210. In some examples, cable clips 117 may be injected molded components formed from plastic materials.

Control panel 111 includes up and down arrows to raise and lower desktop 210. It also includes memory buttons to allow a user to save and recall preset heights. When raising or lowering desktop 210, control panel 111 delivers simultaneous signals to the two motors 150 such that each of the legs 108, 110 extends and retracts in unison.

The specific techniques for adjustable desk frames, including techniques described with respect to adjustable desk frame 100 and adjustable desk 200, are merely illustrative of the general inventive concepts included in this disclosure as defined by the following claims.

What is claimed is:

1. An adjustable desk frame comprising:

a first extendable table leg including a first outer housing, a first inner housing, and a first actuation mechanism to selectively extend and retract the first inner housing relative to the first outer housing;

a second extendable table leg including a second outer housing, a second inner housing, and a second actuation mechanism to selectively extend and retract the second inner housing relative to the second outer housing;

a first motor configured to drive the first actuation mechanism to selectively extend and retract the first inner housing relative to the first outer housing;

a first linkage coupling the first motor to the second actuation mechanism such that the first motor is configured to drive the second actuation mechanism in unison with the first actuation mechanism;

a third extendable table leg including a third outer housing, a third inner housing, and a third actuation mechanism to selectively extend and retract the third inner housing relative to the third outer housing;

a fourth extendable table leg including a fourth outer housing, a fourth inner housing, and a fourth actuation mechanism to selectively extend and retract the fourth inner housing relative to the fourth outer housing;

a second motor configured to drive the third actuation mechanism to selectively extend and retract the third inner housing relative to the third outer housing;

a second linkage coupling the second motor to the fourth actuation mechanism such that the second motor is configured to drive the fourth actuation mechanism in unison with the third actuation mechanism a first crossbar coupling the first outer housing of the first extendable table leg to the second outer housing of the second extendable table leg;

a second crossbar coupling the third outer housing of the third extendable table leg to the fourth outer housing of the fourth extendable table leg;

a third crossbar coupling the first outer housing of the first extendable table leg to the fourth outer housing of the fourth extendable table leg; and a fourth crossbar coupling the second outer housing of the second extendable table leg to the third outer housing of the third extendable table leg, wherein the first crossbar, the second crossbar, the third crossbar, and the fourth crossbar each include multiple segments that facilitate adjustable spacing between the first extendable table leg, the second extendable table leg, the third extendable table leg, and the fourth extendable table leg.

2. The adjustable desk frame of claim 1, wherein the first motor is mounted to the first outer housing of the first extendable table leg.

3. The adjustable desk frame of claim 1, wherein the first linkage includes a telescopic drive shaft.

4. The adjustable desk frame of claim 3, wherein the telescopic drive shaft includes an outer tube with a central lumen, an inner rod within the central lumen and a fitting configured to selectively fix a position of the inner rod within the central lumen relative to the outer tube.

5. The adjustable desk frame of claim 4, wherein the fitting is a threaded compression fitting.

6. The adjustable desk frame of claim 1, wherein the first extendable table leg includes a linear actuator comprising a drive gear coupled to the first motor, and rotatably fixed relative the outer housing, a threaded shaft coupled to the drive gear and extending within the first inner housing, and a threaded nut engaged with the threaded shaft and coupled to the first inner housing to facilitate the extension and retraction of the first inner housing relative to the first outer housing.

7. The adjustable desk frame of claim 6, wherein the drive gear includes a right angle gear box with an input gear coupled to the first motor and an output gear coupled to the threaded shaft, and wherein a housing of the right angle gear box is coupled to the first outer housing.

8. The adjustable desk frame of claim 6, further comprising a gear reducer between the first motor and the drive gear.

9. The adjustable desk frame of claim 1, wherein the first extendable table leg includes a plurality of glide plates configured to mitigate friction between the first outer housing and the first inner housing.

10. The adjustable desk frame of claim 1, wherein the second extendable table leg is mechanically equivalent to the first extendable table leg such that the second extendable table leg extends and retracts in unison with the first extendable table leg in response to rotation of the first motor.

11. The adjustable desk frame of claim 1, further comprising a desktop, wherein the first crossbar and the second crossbar are each attached to an underside of the desktop.

12. The adjustable desk frame of claim 1, wherein the first linkage is extendable to facilitate driving the second actuation mechanism in unison with the first actuation mechanism at various spacings between the first extendable table leg and the second extendable table leg, and wherein the second linkage is extendable to facilitate driving the third actuation mechanism in unison with the fourth actuation mechanism at various spacings between the third extendable table leg and the fourth extendable table leg.

13. The adjustable desk frame of claim 1, further comprising a control panel configured to deliver simultaneous signals to the first motor and the second motor such that each of the first extendable table leg, the second extendable table leg, the third extendable table leg, and the fourth extendable table leg extends and retracts in unison.

14. The adjustable desk frame of claim 13, wherein the control panel includes up and down buttons to raise and lower the adjustable desk frame.

15. A kit for an adjustable desk frame comprising:

a first extendable table leg including a first outer housing, a first inner housing, and a first actuation mechanism to selectively extend and retract the first inner housing relative to the first outer housing;

a second extendable table leg including a second outer housing, a second inner housing, and a second actuation mechanism to selectively extend and retract the second inner housing relative to the second outer housing;

a first motor configured to drive the first actuation mechanism to selectively extend and retract the first inner housing relative to the first outer housing;

a first linkage configured to couple the first motor to the second actuation mechanism such that the first motor is configured to drive the second actuation mechanism in unison with the first actuation mechanism;

a third extendable table leg including a third outer housing, a third inner housing, and a third actuation mechanism to selectively extend and retract the third inner housing relative to the third outer housing;

a fourth extendable table leg including a fourth outer housing, a fourth inner housing, and a fourth actuation mechanism to selectively extend and retract the fourth inner housing relative to the fourth outer housing;

a second motor configured to drive the third actuation mechanism to selectively extend and retract the third inner housing relative to the third outer housing;

a second linkage coupling the second motor to the fourth actuation mechanism such that the second motor is configured to drive the fourth actuation mechanism in unison with the third actuation mechanism;

a first crossbar coupling the first outer housing of the first extendable table leg to the second outer housing of the second extendable table leg; and a second crossbar coupling the third outer housing of the third extendable table leg to the fourth outer housing of the fourth extendable table leg, wherein the first crossbar and the second crossbar each include multiple segments that facilitate adjustable spacing between the first extendable table leg, and the second extendable table leg, and between the third extendable table leg and the fourth extendable table leg, wherein the first linkage is extendable to facilitate driving the second actuation mechanism in unison with the first actuation mechanism at various spacings between the first extendable table leg and the second extendable table leg, and wherein the second linkage is extendable to facilitate driving the third actuation mechanism in unison with the fourth actuation mechanism at various spacings between the third extendable table leg and the fourth extendable table leg.

16. The kit of claim 15, further comprising:

a third crossbar coupling the first outer housing of the first extendable table leg to the fourth outer housing of the fourth extendable table leg; and a fourth crossbar coupling the second outer housing of the second extendable table leg to the third outer housing of the third extendable table leg.

17. The kit of claim 15, wherein the first crossbar and the second crossbar are configured to be attached to an underside of a desktop.

18. The kit of claim 15, wherein the first motor is mounted to the first outer housing of the first extendable table leg, and wherein the second motor is mounted to the third outer housing of the third extendable table leg.

19. The kit of claim 15, wherein the first extendable table leg, the second extendable table leg, the third extendable table leg, and the fourth extendable table leg each include a linear actuator comprising a drive gear, and rotatably fixed relative the outer housing of the respective extendable table leg, a threaded shaft coupled to the drive gear and extending within the inner housing of the respective extendable table leg, and a threaded nut engaged with the threaded shaft and coupled to the inner housing to facilitate the extension and retraction of the inner housing relative to the outer housing of the respective extendable table leg.

20. The kit of claim 15, wherein the second extendable table leg is mechanically equivalent to the first extendable table leg such that the second extendable table leg extends and retracts in unison with the first extendable table leg in response to rotation of the first motor, and wherein the fourth extendable table leg is mechanically equivalent to the third extendable table leg such that the fourth extendable table leg extends and retracts in unison with the third extendable table leg in response to rotation of the second motor.

21. The kit of claim 15, further comprising a control panel configured to deliver simultaneous signals to the first motor and the second motor such that each of the first extendable table leg, the second extendable table leg, the third extendable table leg, and the fourth extendable table leg extends and retracts in unison.

22. The kit of claim 21, wherein the control panel includes up and down buttons to raise and lower the adjustable desk frame.

23. The kit of claim 15, further comprising a desktop, wherein the first crossbar and the second crossbar are configured to be attached to an underside of the desktop.

* * * * *